US009856842B2

(12) United States Patent
Wuerfel et al.

(10) Patent No.: US 9,856,842 B2
(45) Date of Patent: Jan. 2, 2018

(54) FUEL INJECTION DEVICE HAVING A NEEDLE POSITION DETERMINATION

(75) Inventors: Gernot Wuerfel, Vaihingen/Enz (DE); Ingo Pietsch, Munich (DE); Ingo Kerkamm, Stuttgart-Rohr (DE); Andreas Jakobi, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 1143 days.

(21) Appl. No.: 13/514,277

(22) PCT Filed: Oct. 13, 2010

(86) PCT No.: PCT/EP2010/065323
§ 371 (c)(1),
(2), (4) Date: Aug. 17, 2012

(87) PCT Pub. No.: WO2011/069717
PCT Pub. Date: Jun. 16, 2011

(65) Prior Publication Data

US 2012/0325935 A1 Dec. 27, 2012

(30) Foreign Application Priority Data

Dec. 8, 2009 (DE) ..... 10 2009 047 611

(51) Int. Cl.
*F02M 51/06* (2006.01)
*F02M 57/00* (2006.01)
(Continued)

(52) U.S. Cl.
CPC ..... *F02M 51/0603* (2013.01); *F02M 57/005* (2013.01); *F02M 61/08* (2013.01); *F02M 65/005* (2013.01)

(58) Field of Classification Search
CPC ..... F02M 41/126; F02M 45/08; F02M 47/06; F02M 51/0603; F02M 57/005; F02M 61/08; F02M 65/005; F02M 2200/24; F02M 2200/244; F02M 2200/242; F02M 2200/245
(Continued)

(56) References Cited

U.S. PATENT DOCUMENTS 4,359,895 A * 11/1982 Wolff ..... F02M 65/005 123/612
4,462,368 A * 7/1984 Funada ..... 123/446
(Continued)

FOREIGN PATENT DOCUMENTS

CN 1749554 3/2006
CN 101092921 12/2007
(Continued)

*Primary Examiner* — Arthur O Hall
*Assistant Examiner* — Christopher R Dandridge
(74) *Attorney, Agent, or Firm* — Norton Rose Fulbright US LLP; Gerard Messina

(57) ABSTRACT

A fuel injection device includes a nozzle needle, an actuator for actuating the nozzle needle, a force sensor for detecting a force applied by the actuator, and a control unit which is connected to the force sensor. The force sensor supplies signals to the control unit and the control unit is designed for determining a position of the nozzle needle and for precisely determining an injected fuel quantity, based on the supplied signal.

7 Claims, 3 Drawing Sheets

(51) Int. Cl.
*F02M 61/08* (2006.01)
*F02M 65/00* (2006.01)

(58) Field of Classification Search
USPC ..... 239/533.1, 533.2, 533.3, 569, 583, 584, 239/585.1–585.5, 900, 73, 533.7, 533.9
See application file for complete search history.

(56) References Cited

U.S. PATENT DOCUMENTS 4,483,480 A * 11/1984 Yasuhara ..... F02M 65/005 239/533.3
4,499,878 A * 2/1985 Igashira et al. ..... 123/478
4,718,390 A * 1/1988 Gonda et al. ..... 123/500
6,253,736 B1 * 7/2001 Crofts ..... F02M 65/005 123/467
6,292,192 B1 * 9/2001 Moreton ..... G06T 17/30 345/423
6,929,192 B2 * 8/2005 Schmauser ..... F02M 51/0603 239/102.2
7,896,257 B2 * 3/2011 Yan ..... F02M 47/027 123/446
2009/0140610 A1 6/2009 Venkataraghavan et al.
2009/0289131 A1 11/2009 Shingu et al.
2013/0026257 A1 * 1/2013 Jalal ..... F02M 51/0603 239/585.5

FOREIGN PATENT DOCUMENTS

CN 100432415 11/2008
DE 38 30 510 12/1989
DE 19939456 A1 11/2000
DE 101 27 932 12/2002
DE 101 29 375 1/2003
GB 2 092 223 8/1982
GB 2092223 * 8/1982 ..... F02M 41/126
JP H10288119 * 10/1998 ..... F02D 41/20

* cited by examiner

FUEL INJECTION DEVICE HAVING A NEEDLE POSITION DETERMINATION

FIELD OF THE INVENTION

The present invention relates to a fuel injection device having a needle position determination for the exact determination of a needle position and in particular a high-precision determination of an injected fuel quantity.

BACKGROUND INFORMATION

Various embodiments of fuel injection devices are known from the related art. In addition to magnetic injectors, piezoelectric multi-layer actuators are also used. In this connection, one advantage of piezoelectric actuators is that they are able to carry out deflections very quickly and precisely while simultaneously exercising great forces. One disadvantage of such piezoelectric actuators is, however, that the property degradation of the ceramic components of the piezoelectric actuator as a function of the number of electrical cycles makes a direct correlation of the applied voltage with the expansion of the piezoelectric actuator impossible. This prevents an exact determination of an actual needle position of a nozzle needle of the fuel injection device (needle lift characteristics) at any point in time of the injection process. Furthermore, the actual nozzle needle position in the nozzle seat is influenced by wear, carbon build-up, etc., which is impossible to detect in conventional fuel injection devices. For that reason, a measurement and coding is performed on each piezoelectric actuator before its installation. With the aid of this information, the particular stroke capability of an individual piezoelectric actuator is ascertained. This makes it possible to calculate a theoretical metering of the injected fuel quantity for each piezoelectric actuator. However, the fact that each individual piezoelectric actuator must be measured results in considerable manufacturing expense. Furthermore, the individual control units for the fuel injection device must also be adapted individually to the piezoelectric actuator. Moreover, the theoretically ascertained value may deviate significantly from later actual needle lift characteristics in the installed condition of the piezoelectric actuator. This results in inaccuracies in the injected fuel quantity. It would therefore be desirable to have a possibility for an exact needle position at each point in time of the injection process and to calculate from it a particular injected fuel quantity.

SUMMARY OF THE INVENTION

The fuel injection device according to the present invention has the advantage over the related art that, with the aid of a sensor, it is able to determine an exact position of a nozzle needle (needle lift characteristics) at any point in time. Based on the exact position of the nozzle needle, it is possible to make a precise determination of an injected fuel quantity. According to the present invention, this creates a basis for a further increase in efficiency in the case of internal combustion engines, since an extremely exact determination of an injected fuel quantity is possible, which contrasts significantly from the possibilities previously known from the related art. Another advantage lies in an expanded diagnostic capability of the injector, since mechanical defects such as, for example, jamming, and/or wear caused, for example, by carbon build-up, are detectable. Furthermore, resources in the control unit of the fuel injection device may be saved, and an improved protection against undesirable tuning of the internal combustion engine is possible, since the interposition of a tuning control unit for increasing the power of the internal combustion engine and accordingly changing a setpoint quantity for the injection is made more difficult. According to the present invention, this is achieved in that the fuel injection device includes a force sensor for detecting a force applied by an actuator as well as a control unit. The control unit is connected to the force sensor and designed for determining a position of the needle based on the signals supplied by the force sensor. A precise determination of an injected fuel quantity is made using the position determination. The force sensor is thus used for detecting the actuator force, which in the case of piezoelectric actuators is correlated with an accompanying change of length of the piezoelectric actuator. In the case of magnetic injectors, the force of the magnetic actuator is correlated with the movement of the magnetic actuator. For that reason, the idea according to the present invention may be used in magnetic injectors and in piezoelectric actuators independent of the type of actuator, a use in the case of piezoelectric actuators being particularly practical due to the great possibilities for simplification.

The force sensor is preferably a piezoelectric sensor. The piezoelectric sensor may be designed to be single-layered or multi-layered. Furthermore, the use of a piezoelectric sensor as a force sensor makes it possible to have a low overall height and accordingly a compact design.

It is preferred in particular that the actuator of the fuel injection device is a piezoelectric actuator. In addition to the known advantages of using piezoelectric actuators, this yields the above-mentioned manufacturing advantages, so that it is possible to install the piezoelectric actuators directly without additional measurement and it is not necessary to adapt control units individually to the piezoelectric actuators.

According to a preferred embodiment of the present invention, the force sensor includes a passage opening, a nozzle needle of the fuel injection device being guided through the passage opening. The force sensor is connected to a restoring spring for the actuator and detects a restoring force provided by the restoring spring, the restoring force being designed according to the actuator force. This design of the force sensor makes it possible in particular to keep an overall axial length of the fuel injection device unchanged, since no need exists for an additional component to be provided between the nozzle needle and the actuator in the axial direction.

According to a preferred alternative of the present invention, the force sensor is situated in the force flow between the actuator and the nozzle needle. This does cause the overall axial length to be greater by the thickness of the force sensor; however, the force sensor is able to absorb an actuator force directly. It is preferred in particular that the force sensor is designed in disk form in order to have as short an axial length as possible.

For a particularly compact design, the force sensor is furthermore preferably in direct contact with the actuator or integrated into it by preferably using an identical piezoceramic material for the actuator and the sensor.

The present invention may be used with all types of fuel injectors; however, it is particularly advantageous in the case of piezoelectric actuators. In the case of piezoelectric actuators in particular, the present invention makes it possible to further reduce the cost of manufacturing significantly and makes possible a more exact metering of the injected fuel quantity, resulting in a novel basis for a further increase in efficiency and accordingly in fuel savings.

DETAILED DESCRIPTION

Figure 1:
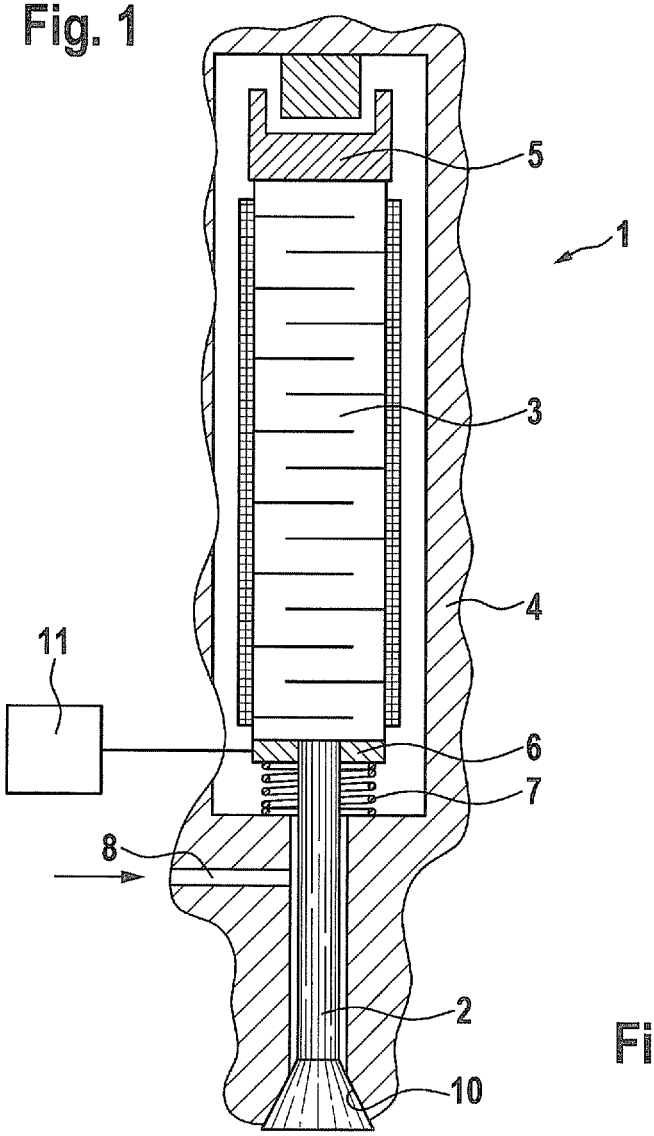
FIG. 1 shows a schematic sectional view of a fuel injection device according to a first exemplary embodiment of the present invention.
Figure 2:
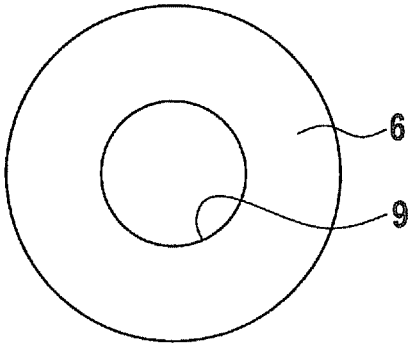
FIG. 2 shows a top view of a force sensor from FIG. 1.

With reference to FIGS. 1 and 2, a fuel injection device 1 according to a first preferred exemplary embodiment of the present invention will be described in greater detail below.

As is apparent from FIG. 1, fuel injection device 1 includes a nozzle needle 2 which is connected directly to an actuator 3. In this exemplary embodiment, actuator 3 is a multilayer piezoelectric actuator. Nozzle needle 2 is an outward opening nozzle needle which opens and closes an outlet opening on a valve seat 10. Fuel injection device 1 further includes a valve housing 4, a hydraulic coupling 5 and a restoring spring 7. Restoring spring 7 is used for resetting actuator 3 after an injection process is completed. Furthermore, fuel injection device 1 includes a force sensor 6. As is apparent from FIG. 1, force sensor 6 is situated directly on the nozzle needle end of the piezoelectric actuator.

FIG. 2 shows a top view of force sensor 6 which is designed as an annular disk. In the center, force sensor 6 includes a cylindrical passage opening 9. As is apparent from FIG. 1, an actuator-side end of nozzle needle 2 is guided through force sensor 6, more exactly through passage opening 9. Force sensor 6 is situated between actuator 3 and restoring spring 7, restoring spring 7 being supported on valve housing 4. Thus a restoring force of restoring spring 7 acts on the piezoelectric actuator via force sensor 6 if the length of the piezoelectric actuator changes. Thus force sensor 6 is not situated directly in the force flow between nozzle needle 2 and the piezoelectric actuator; however, it is nonetheless moved if the length of the piezoelectric actuator changes. In this exemplary embodiment, a deflection of actuator 3 causes the actuator to be elongated in the direction of nozzle needle 2, so that restoring spring 7 is compressed via force sensor 6. The counterforce of restoring spring 7 built up in this way may be detected by force sensor 6 as a force signal.

As is further apparent from FIG. 1, force sensor 6 is connected to a control unit 11. The signals recorded by force sensor 6 are supplied to this control unit 11. Control unit 11 is designed in such a way that, based on the supplied signals of force sensor 6, it is able to precisely determine the position of the needle. Based on this position determination, control unit 6 is then able to determine an injected fuel quantity. In this connection, it is possible for the supplied fuel to be always supplied at a consistent pressure, or alternatively or redundantly, an additional pressure sensor may transmit signals to the control unit which detects the prevailing pressure in the area of a fuel line 8 or in the area upstream from nozzle needle 2. Based on the pressure, an opening time, and the nozzle position, it is then possible to calculate an exact injection quantity, it being possible to use the needle position for determining an opening cross section for spraying out fuel.

According to the present invention, it is thus possible to determine an exact needle position at any point in time, making it possible to use the duration of the current feed to the piezoelectric actuator for defining an exact injection quantity. This also makes it possible to omit the so-called "actuator coding," i.e., the individual measurement of each actuator during actuator manufacturing, which results in a significant cost reduction, including in the particular control units.

Figure 3:
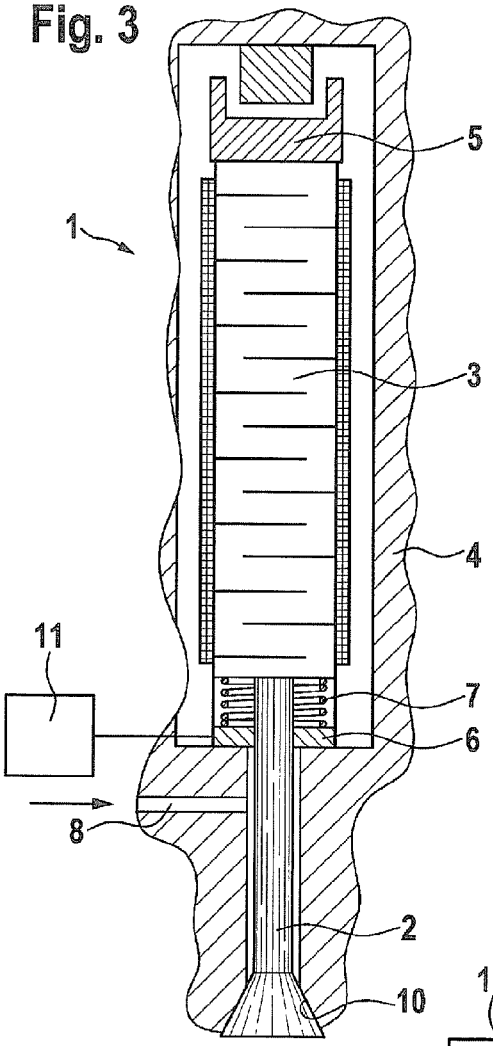
FIG. 3 shows a schematic sectional view of a fuel injection device according to a second exemplary embodiment of the present invention.

With reference to FIG. 3, a fuel injection device 1 according to a second exemplary embodiment of the present invention will be described in greater detail below. Identical or functionally identical parts are denoted using the same reference numerals as in the preceding exemplary embodiment.

As is apparent from FIG. 3, a position of force sensor 6 is different in the second exemplary embodiment than in the first exemplary embodiment. More accurately, force sensor 6 is situated in the fuel injection device in such a way that restoring spring 7 is situated between force sensor 6 and actuator 3 in the axial direction. Force sensor 6 is thus no longer in direct contact with the actuator but instead restoring spring 7 is interconnected. A spring force of restoring spring 7 acts in the same way on force sensor 6 in the case of a change of length of actuator 3 as described in the first exemplary embodiment.

Figure 4:
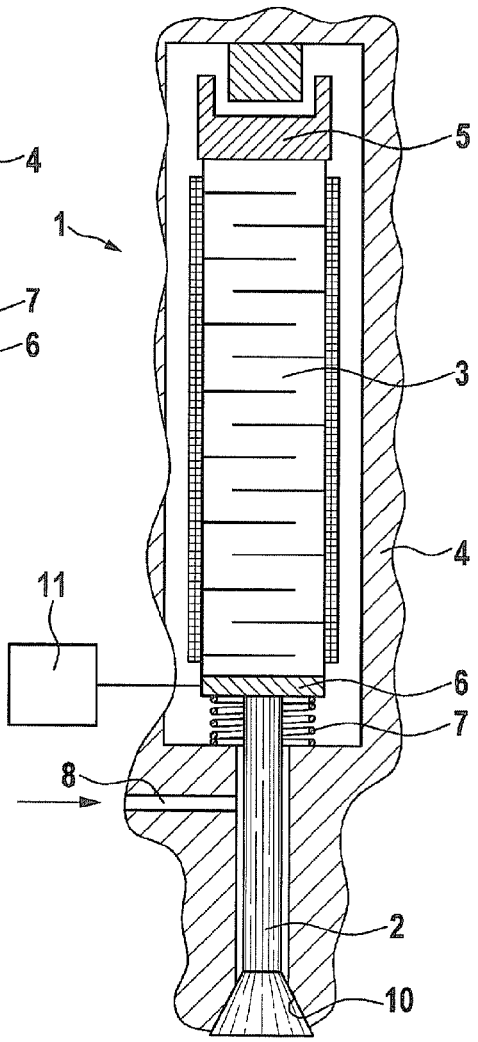
FIG. 4 shows a schematic sectional view of a fuel injection device according to a third exemplary embodiment of the present invention.
Figure 5:
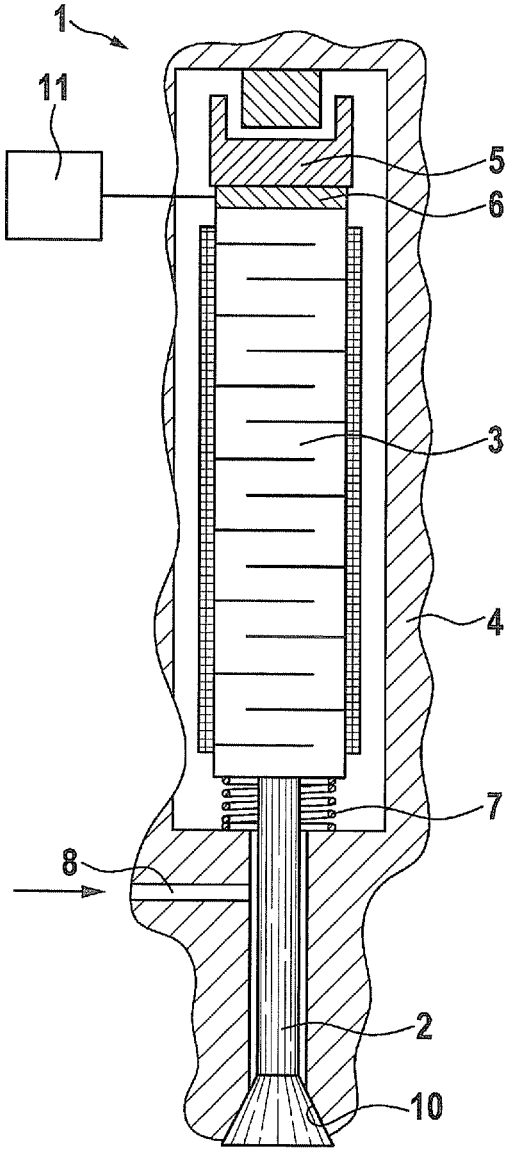
FIG. 5 shows a schematic sectional view of a fuel injection device according to a fourth exemplary embodiment of the present invention.

FIGS. 4 and 5 show a third and fourth exemplary embodiment of the present invention, identical reference numerals denoting functionally identical parts. In the case of the third and fourth exemplary embodiments, force sensor 6 is situated in the force flow between actuator 3 and nozzle needle 2. In the case of the third exemplary embodiment shown in FIG. 4, force sensor 6 lies between actuator 3 and nozzle needle 2 and is in direct contact with restoring spring 7. Force sensor 6 is in this case designed as a disk without a center passage opening, and a deflection of actuator 3 again causes restoring spring 7 to be compressed, which force sensor 6 is able to detect and accordingly outputs a corresponding force signal to control unit 11. As described in the third exemplary embodiment, force sensor 6 may in this case be situated at the needle-side end of the actuator in FIG. 4, or as shown in the fourth exemplary embodiment of FIG. 5, at the needle-distal end, adjacent to hydraulic coupler 5. It may furthermore be noted that, of course, still additional intermediate components may be situated between actuator 3 and force sensor 6 in the third and fourth exemplary embodiment.

What is claimed is:

1. A fuel injection device comprising:

a nozzle needle;

an actuator for actuating the nozzle needle, wherein the actuator is a magnetic actuator or a piezoelectric actuator;

a force sensor for determining a force applied by the actuator; and a control unit connected to the force sensor, the force sensor supplying a force measurement signal to the control unit, the control unit using the force measurement signal to calculate a value of the position of the nozzle needle and using the calculated value to calculate an injected fuel quantity.

2. The fuel injection device according to claim 1, wherein the force sensor is a piezoelectric sensor.

3. The fuel injection device according to claim 1, wherein the actuator is a piezoelectric actuator.

4. The fuel injection device according to claim 1, wherein the force sensor has a passage opening, the nozzle needle being guided through the passage opening, and the force sensor being connected to a restoring spring for resetting the actuator and detecting a restoring force provided by the restoring spring.

5. The fuel injection device according to claim 1, wherein the force sensor is situated in a force flow between the actuator and the nozzle needle.

6. The fuel injection device according to claim 5, wherein the force sensor is designed in disk form.

7. The fuel injection device according to claim 1, wherein the force sensor contacts the actuator directly or the force sensor is integrated into the actuator.

* * * * *